US007290773B2

(12) United States Patent
Eck

(10) Patent No.: US 7,290,773 B2
(45) Date of Patent: Nov. 6, 2007

(54) GLIDE SPORT ARTICLE, ESPECIALLY ICE SKATE

(76) Inventor: Michael Eck, c/o Californian Products (H.K.) Ltd., Unit 1,4/F., Skyway House, No. 3, Sham Mong Road, Tai Kok Tsui, Kowloon (HK)

( * ) Notice: Subject to any disclaimer, the term of this patent is extended or adjusted under 35 U.S.C. 154(b) by 162 days.

(21) Appl. No.: 10/808,616

(22) Filed: Mar. 25, 2004

(65) Prior Publication Data

US 2005/0179222 A1 Aug. 18, 2005

(30) Foreign Application Priority Data

Feb. 17, 2004 (DE) ..... 10 2004 007 868

(51) Int. Cl.
*A63C 17/06* (2006.01)

(52) U.S. Cl. ..... 280/11.12; 280/11.18; 280/11.16; 280/11.26; 280/845; 280/11.221

(58) Field of Classification Search ..... 280/841, 280/11.12, 11.18, 11.16, 11.26, 845, 11.221
See application file for complete search history.

(56) References Cited

U.S. PATENT DOCUMENTS

| | | | | |
|---|---|---|---|---|
| 4,351,537 | A * | 9/1982 | Seidel | 280/11.12 |
| 4,509,276 | A * | 4/1985 | Bourque | 36/115 |
| 4,835,885 | A * | 6/1989 | Hoshizaki et al. | 36/115 |
| 5,210,963 | A * | 5/1993 | Harwood | 36/77 R |
| 5,234,230 | A * | 8/1993 | Crane et al. | 280/811 |
| 5,342,070 | A * | 8/1994 | Miller et al. | 280/11.231 |
| 6,669,210 | B2 * | 12/2003 | Chen | 280/11.16 |

* cited by examiner

*Primary Examiner*—Christopher P. Ellis
*Assistant Examiner*—Cynthia F. Collado
(74) *Attorney, Agent, or Firm*—Hoffman, Wasson & Gitler

(57) ABSTRACT

For a glide sport article, especially an ice skate with a shoe body that is located on a chassis and that includes a cap-like shoe tip forming the toe area of the shoe body, a shoe body section forming the heel area and an ankle support, lacing on the shoe body section and a tongue located beneath the lacing, the shoe tip can be adjusted in a shoe body direction relative to the shoe body section on the chassis.

9 Claims, 3 Drawing Sheets

GLIDE SPORT ARTICLE, ESPECIALLY ICE SKATE

BACKGROUND OF THE INVENTION

The invention pertains to a glide sport article, especially an ice skate and in particular to a hockey skate.

An object of the invention is to present a glide sport article that is especially suited for children and that enables adjustment and adaptation of the length of the shoe or shoe element to different foot sizes over a relatively large range, however while still fulfilling the requirements exhibited especially by hockey skates, above all with respect to an optimum fit on the foot of the wearer and also optimum protection and sufficient stability.

SUMMARY OF THE INVENTION

A special feature of the invention is, for example, that the shoe body section that is permanently fastened to the chassis extends over the greater length of the shoe body, or shoe, and forms its sides, the heel area and the support there for the leg area above the ankle and also contains the lacing, while the shoe tip, which is adjustable in the longitudinal direction of the shoe body, or in the longitudinal direction of the chassis, protrudes from the shoe body section only with a much smaller length.

A further special feature is that the tongue, located beneath the lacing of the shoe, is connected with the shoe tip and is adjusted with the latter and that the shoe body section, that is permanently connected with the chassis, overlaps the cap-like shoe tip on its outer surface, namely over an area that is greater than the maximum adjusting area of the shoe tip.

BRIEF DESCRIPTION OF THE DRAWINGS

The invention is described in more detail below based on the drawings and a sample embodiment.

DETAILED DESCRIPTION OF THE INVENTION

Figure 1:
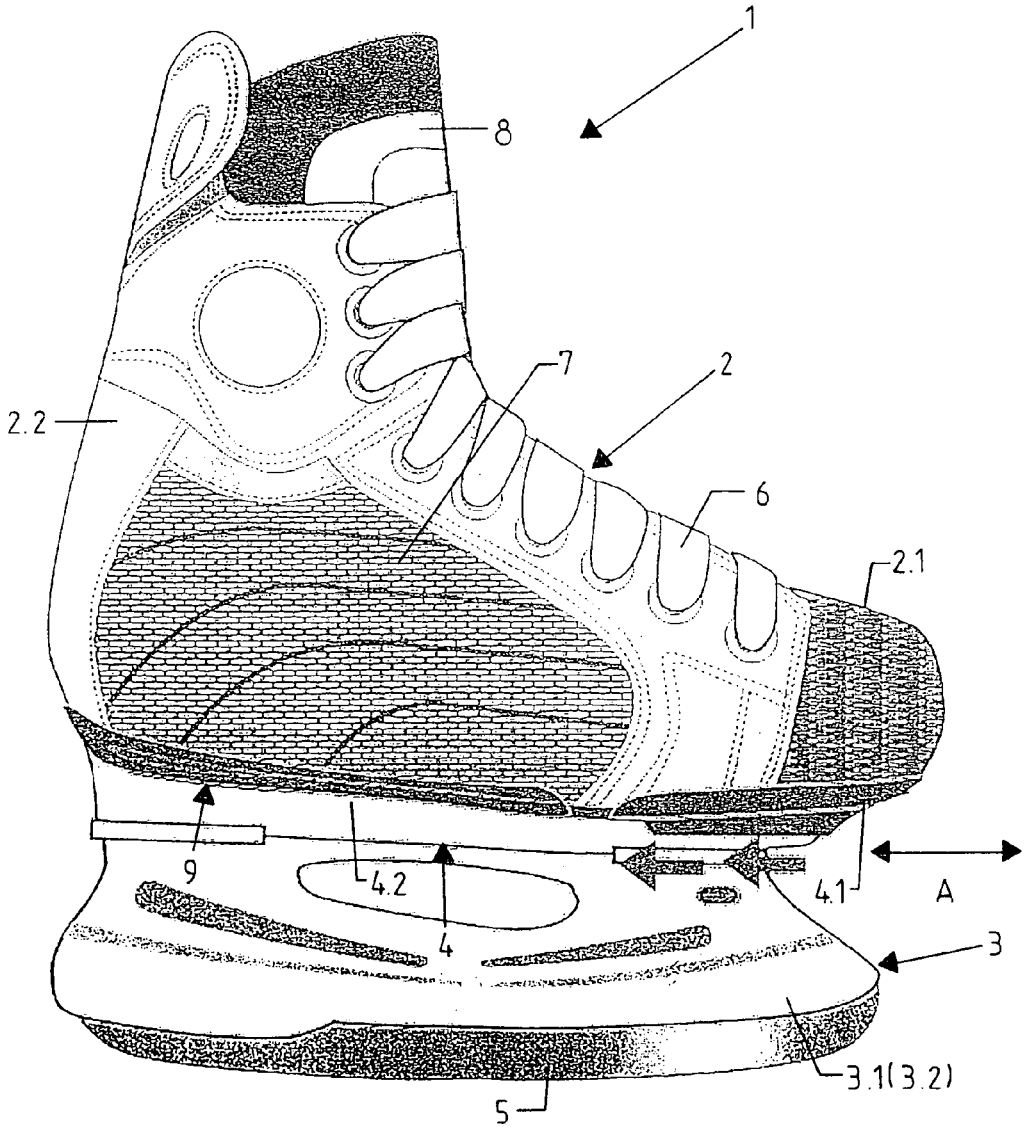
FIG. 1—simplified depiction in side view of a hockey skate with a shoe body of adjustable length.

In the drawing, 1 generally designates a hockey skate consisting of an upper shoe or shoe body 2, of a chassis 3 connected with the sole 4 of the shoe body 2 and supporting the latter, and of a runner 5 located on the bottom of the chassis 3. In the depicted embodiment, the chassis 3 is essentially manufactured from plastic as a molded part. The runner 5 is made of steel.

The shoe body 2 comprises a shoe tip 2.1 and a shoe body section 2.2, as is known in the art. The latter contains the usual lacing 6 on the front of the shoe body 2, located at the top front of the shoe body section 2.2 and with which the shoe can be tied to the foot of the user. In the depicted embodiment, the lacing 6 reaches to the cap-like shoe tip 2.1. Furthermore, the shoe body section 2.2 forms the heel area of the shoe 2 with an ankle support.

The shoe body section 2.2 reaches from the rear or the heel area of the shoe body to the shoe tip 2.1, such that the latter protrudes forward from the shoe body section 2.1 with only a very small length in comparison with the overall length of the shoe body 2. In the depicted embodiment, the length of the shoe body section 2.2 is at least 70% of the maximum total length of the shoe body 2. The cap-like shoe tip 2.1 and the shoe body section 2.2 are manufactured of materials suitable for shoes for hockey skates. Furthermore, the shoe body section 2.2 is provided with a reinforcement on the side, i.e. with an impact guard 7, which extends above the sole 4 and beneath the lacing 6 from the heel area of the shoe body 2 to the vicinity of the shoe tip 2.1. Beneath the lacing 6 is the usual tongue 8, which is permanently connected with the cap-like shoe tip 2.1. The latter is overlapped on the outside by the shoe body section 2.1 and can be adjusted in stages relative to the shoe body section 2.2 on the chassis 3 corresponding to the double arrow A in FIG. 1, namely by a pre-defined, maximum adjustment distance for adapting the shoe to different foot sizes.

For this purpose, the shoe tip 2.1 can move in a guide with part of the sole 4 or with the sole element 4.1 on the chassis 3. The chassis 3 comprises two rail-like ridges or guides 10, each of which protrudes over one longitudinal side of the chassis and each of which engages in a longitudinal groove 11 on the bottom of the sole element 4.1. For the formation of the grooves 11 the sole element 4.1 is provided with a T-shaped grooved recess 12, which forms the guide grooves 1 with its lateral extensions.

Figure 4:
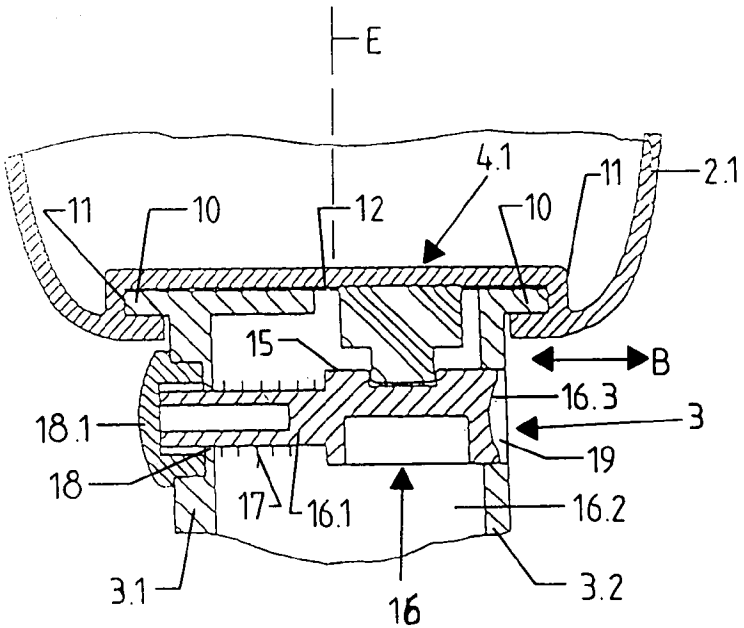
FIGS. 3-4—partial views of the front, adjustable cap.
Figure 2:
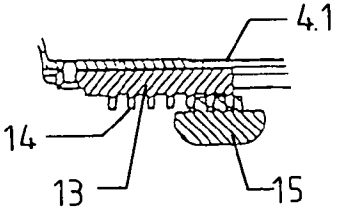
FIG. 2—an enlarged individual depiction in cross section of the front, adjustable cap of the shoe element, together with the chassis or frame of the ice skate.

On the sole element 4.1 there is a toothed strip 13 protruding over the bottom of the sole element and extending in longitudinal direction and therefore in the adjustment direction of the shoe tip 2.1 and which has a plurality of teeth 14 on its bottom side. The toothed strip 13 or its teeth 14 act in combination with gear teeth 15 located on a locking element 16. The latter can move on bearings (double arrow B) in the chassis 3 in an axis that is perpendicular to a plane E, which encloses the longitudinal axis of the skate and is also the middle axis of the chassis 3, namely against the effect of a pull-back spring 17 from a position (FIG. 3) locking the toothed strip 13 and therefore the shoe tip 2.1 into a position (FIG. 4) releasing the toothed strip 13 and therefore the shoe tip 2.1.

Figure 3:
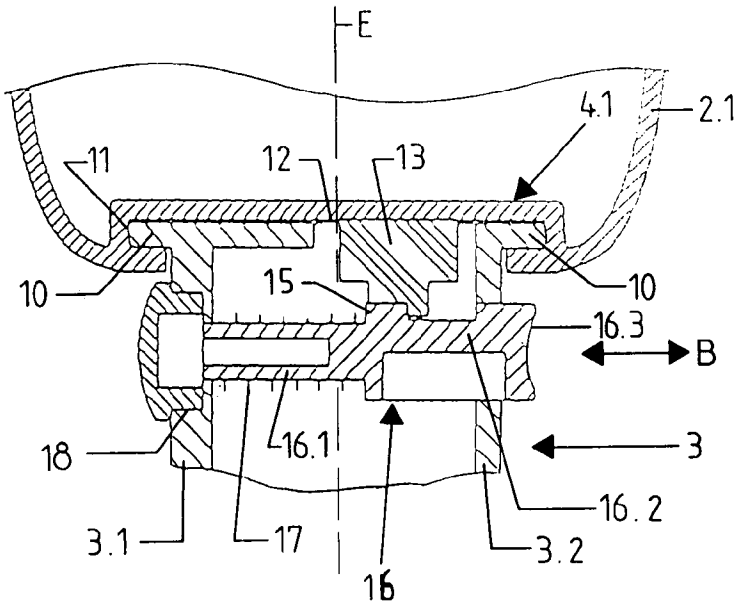

The locking element 16, in the depicted embodiment, and the toothed strip 13 are molded parts made of plastic. For guiding the locking element 16, openings are provided for the locking element 16 in the walls 3.1 and 3.2 of the chassis 3, which is designed as a hollow body, namely one opening in the wall 3.1 for a peg-like section 16.1 of the locking element on which (element) the spring 17 for this section is also located, and one opening 19 for the section 16.2 of the locking element. The teeth 15 are also located on the section 16.2. The section 16.2 has a non-circular cross section, i.e. in the depicted embodiment an oval cross section, to which the opening 19 is adapted, so that the locking element 16 is held in the chassis 3 so that it is axially movable but unable to twist. On the end that is distant from the section 16.1, the section 16.2 forms an actuating or pressure surface 16.3, which protrudes beyond the outer surface of the wall 3.2 of the chassis 3 when the spring 17 is released, i.e. when the toothed strip is locked (FIG. 3). In this state, the teeth 15 engage in the toothed strip 13. Pressing the actuating or pressure surface 16.3 causes the locking element 16 to move against the effect of the spring 17 far enough that the teeth 15 disengage from the toothed strip 13. The opening 18 is closed by a cover 18.1.

FIG. 5 again shows, in a simplified schematic depiction, the sole element 4.1 in bottom view, together with the sole section or element 4.2 that is permanently connected with the shoe body section 2.2, by means of which (sole element) the shoe body 2 or the shoe body section 2.2 is permanently connected with the chassis 3, e.g. by means of rivets or other suitable fastening means.

Figure 5:
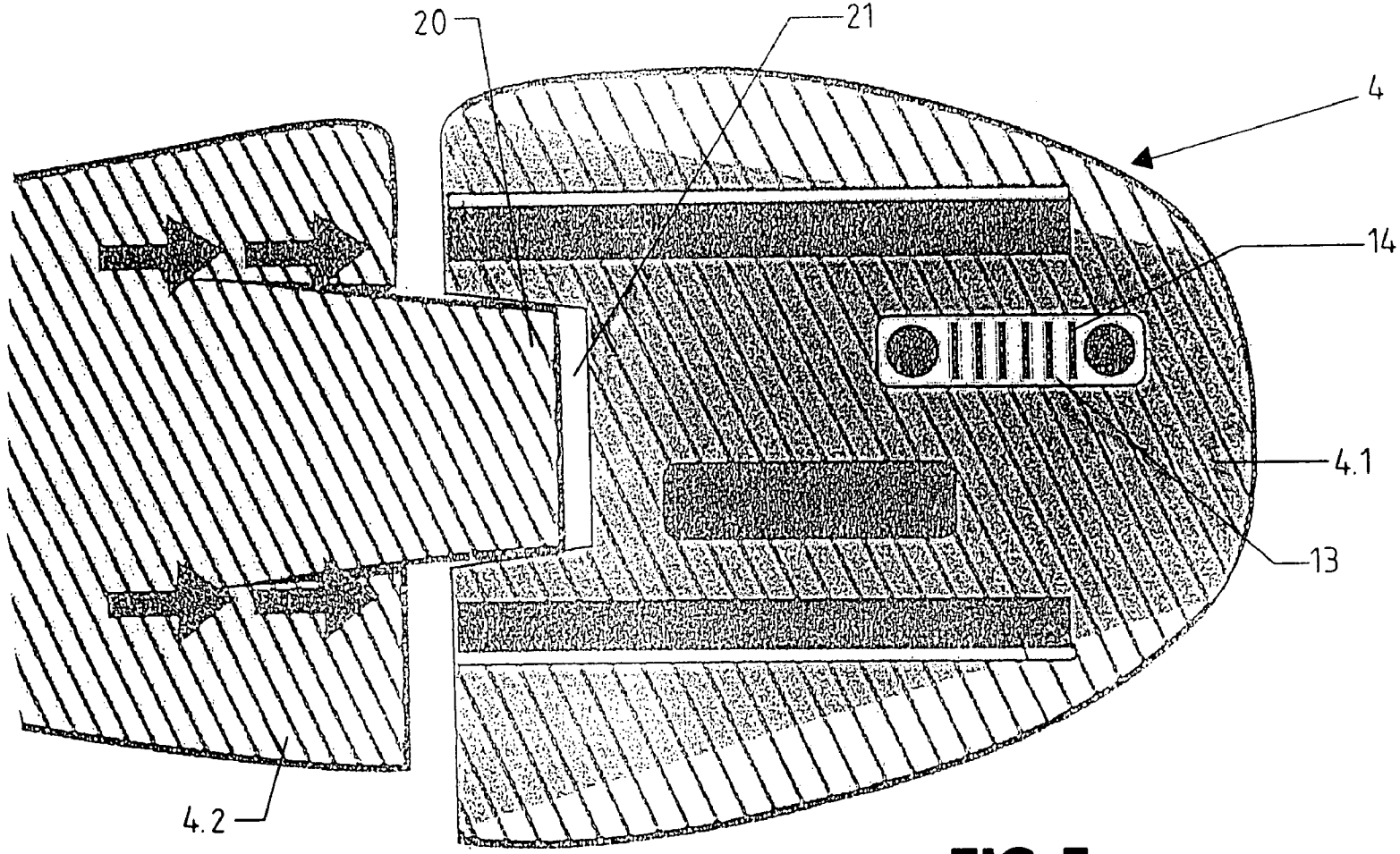
FIG. 5—a schematic depiction in front view of the sole.

In order to seal the shoe body 2 in the area of the sole 4, especially against penetration by water, the two sole elements 4.1 and 4.2 are designed so that these two sole elements overlap at least partially in any adjustment position of the shoe tip 2.1. In the depicted embodiment the overlapping is achieved by the fact that the sole element 4.2 comprises a tongue 20, which engages in a recess 21 of the sole element 4.1, as depicted in FIG. 5.

The invention was described above based on a sample embodiment. It goes without saying that numerous modifications and variations are possible without abandoning the inventive idea upon which the invention is based.

Reference Marks

| | |
|---|---|
| 1 | ice skate, especially ice hockey skate |
| 2 | body of shoe |
| 2.1 | tip of shoe |
| 2.2 | section of shoe body |
| 3 | chassis |
| 3.1, 3.2 | side wall of chassis |
| 4 | sole |
| 4.1, 4.2 | sole element |
| 5 | runner |
| 6 | lacing |
| 7 | reinforcement |
| 8 | tongue |
| 9 | top side |
| 10 | guide |
| 11 | guide groove |
| 12 | recess |
| 13 | toothed strip |
| 14 | tooth |
| 15 | gear teeth |
| 16 | locking element |
| 16.1, 16.2 | section |
| 16.3 | actuating surface |
| 17 | pull-back spring |
| 18, 19 | opening |
| 18.1 | cover |
| 20 | tongue |
| 21 | recess |
| A | adjustment of shoe tip 2.1 |
| B | movement of the locking element 16 |
| E | middle plane of the ice skate or of the chassis 3 |

What is claimed is:

1. A glide sport article having a shoe body that is located on a chassis and that comprises a cap-like shoe tip forming a toe area of the shoe body, a shoe body section forming the heel area and an ankle support, lacing on the shoe body section and a tongue located beneath the lacing, wherein the shoe tip is provided in a shoe body longitudinal direction relative to the shoe body section on the chassis, the shoe body section extends on the sides of the shoe body over the greater length of the shoe body, the shoe body section extends beyond the shoe tip on its outer side, the shoe body section and the shoe tip overlap each other in the longitudinal direction of the chassis with a length that is greater than the maximum adjusting area of the shoe tip relative to the chassis, and further comprising means for locking the shoe tip on the chassis, said means for locking the shoe tip comprise (i) a counter-catch on the shoe tip or an a sole section of the shoe tip and (ii) a locking element which has at least one catch counter acting with the counter-catch and which can be slid in the chassis against the force of a reset springs in an axis that is perpendicular to the shoe body longitudinal direction from a shoe tip locking position to a shoe tip release position.

2. The glide sport article as claimed in claim 1 wherein the catch comprises at least one tooth and the counter-catch comprises teeth of a toothed strip.

3. The glide sport article as claimed in claim 1, wherein the length of the shoe body section in the direction of the chassis is greater by a multiple of the length of the shoe tip.

4. The glide sport article as claimed in claim 3, wherein the length of the shoe body section in the direction of the chassis is at least 70% of the maximum total length of the shoe body.

5. The glide sport article as claimed in claim 1, wherein the lacing reaches from an area of the shoe body section adjacent to the shoe tip to an upper shoe body opening.

6. The glide sport article as claimed in claim 1, wherein the lacing reaches from the shoe tip to an upper shoe body opening.

7. The glide sport article as claimed in claim 1, wherein the shoe body section has a reinforcement or an impact guard at least on one side, located above a sole of the shoe body and below the lacing and extends from the heel area up to the vicinity of the shoe toe.

8. The glide sport article as claimed in claim 1, wherein the shoe tip is guided with a sole section on at least one guide provided on the chassis.

9. The glide sport article as claimed in claim 8, wherein the guide is made of two guide rails at a distance from each other and extending parallel to each other and in the longitudinal direction of the chassis, each of the guide rails engages in a guide groove on the sole section of the shoe tip.

* * * * *